United States Patent [19]

Ichikawa

[11] Patent Number: 5,048,846

[45] Date of Patent: Sep. 17, 1991

[54] METHOD FOR SEALING GAS RELEASE VALVE

[75] Inventor: Makoto Ichikawa, Tokyo, Japan

[73] Assignee: Fujimori Kogyo Co., Ltd., Tokyo, Japan

[21] Appl. No.: 409,598

[22] Filed: Sep. 6, 1989

[30] Foreign Application Priority Data

Sep. 12, 1988 [JP] Japan ..... 63-227747

[51] Int. Cl.[5] ..... B31B 1/84

[52] U.S. Cl. ..... 277/1; 493/87; 493/213; 493/929; 220/209

[58] Field of Search ..... 53/403, 405, 408, 410, 53/84, 102, 105, 128, 129; 277/1, 72 FM; 493/929, 87, 213; 426/118; 383/100, 103; 220/209, 367; 137/852

[56] References Cited

U.S. PATENT DOCUMENTS

| | | | |
|---|---|---|---|
| 4,290,253 | 9/1981 | Domke et al. | 53/480 |
| 4,420,015 | 12/1983 | Blaser | 220/209 |
| 4,444,219 | 4/1984 | Hollenstein | 383/103 |
| 4,690,667 | 9/1987 | Domke | 383/103 |
| 4,890,637 | 1/1990 | Lamparter | 426/118 |

FOREIGN PATENT DOCUMENTS

| | | | |
|---|---|---|---|
| 3031208 | 2/1982 | Fed. Rep. of Germany | 383/103 |
| 3229242 | 2/1984 | Fed. Rep. of Germany | 383/103 |

*Primary Examiner*—William A. Cuchlinski, Jr.
*Assistant Examiner*—Alvin Wirthlin

[57] ABSTRACT

A method for filling gas release valves with sealant for affixing to packaging containers to be filled with a commodity which will generate a small amount of gases during shelf storage. The gas release valve having an apertured base film and a valve film superimposed on the base film to define a channel therebetween is attached to the container in registry with a vent in the container such that the valve may allow the gases given off by the commodity to escape to the exterior through the vent and the channel when the gas pressure rises beyond the atmospheric pressure. Before the gas release valve is attached to the container, the valve is sealed by inserting a nozzle into said channel through the aperture in the base film, and introducing a fluid sealant through the nozzle into the channel intermediate one peripheral edge of the channel and the circumference of the aperture, thereby filling the channel with the fluid sealant.

3 Claims, 4 Drawing Sheets

METHOD FOR SEALING GAS RELEASE VALVE

BACKGROUND OF THE INVENTION

1. Field of the Invention

This invention relates to a method for sealing a gas release valve adapted to be attached to a sealing container for packaging a commodity which will generate a small amount of gases during shelf storage, for example, roasted coffee beans, such that the valve covers a vent hole in the container whereby the valve allows the gas filling in the container given off from the commodity to escape from the container.

2. Prior Art

Conventional gas release valves typically include a base film having an aperture and a valve film superimposed on one surface of the base film to cover the aperture and to define a channel therebetween for releasing the gas to exterior through the aperture. Examples of the type of valve are known in the art as disclosed in Japanese Patent Application Kokai Nos. 32244/1981, 57069/1985, 6278/1988, and 6279/1988. It is also known to seal such a gas release valve by applying fluid sealant such as silicone fluid to the channel of the valve in order to smoothly open and close the channel as disclosed in Japanese Patent Publication No. 29501/1984, Japanese Patent Application Kokai No. 152551/1988, and Domke et al., U.S. Patent Re. 32,018 reissued Nov. 5, 1985. The sealing method of Japanese Patent Publication No. 29501/1984 applies sealant to an outer end portion of the channel, and the sealing method of Japanese Patent Application Kokai No. 152551/1988 applies sealant to a circumferential portion about the aperture in the channel.

The sealing method of Japanese Patent Publication No. 29501/1984 has several drawbacks. The method fails to evenly fill the channel with the sealant since the sealant does not readily spread throughout the channel, especially up to a remote portion of the channel. When the sealant is applied to the outer end portion of the channel, the sealant adheres near to the channel outer end, contaminating the periphery and surface of the valve and thus staining the packaging container to which the valve is attached.

An improvement over this sealing method is disclosed in Japanese Patent Application Kokai No. 152551/1988, which suffers from a similar drawback since a substantial portion of the sealant applied to the inner peripheral portion of the channel can remain there. When the valve is attached to the packaging container in registry with its vent hole, the sealant remaining near the circumference of the aperture in the channel will penetrate into the container through the vent hole, contaminating the contents.

Neither of the above-mentioned methods can ensure that the channel will be evenly filled with a desired amount of sealant. Since these methods achieve penetration of sealant throughout the channel largely by a capillary flow from one end to another end, it is difficult to control relative fractions of the sealant to spread over and to remain near the applied site.

SUMMARY OF THE INVENTION

Therefore, an object of the present invention is to provide an improved method for sealing a gas release valve which can evenly, quickly, and readily fill the valve channel with a predetermined amount of liquid sealant while preventing any contamination by the sealant of the valve itself or a packaging container to which the valve is attached.

A packaging container is to be filled with a commodity which will generate a small amount of gases during shelf storage, has a vent hole formed therein. A gas release valve is adapted to be attached to the container to cover the vent hole whereby the valve allows the gases given off by the commodity to escape to the exterior through the vent hole when the gas pressure rises beyond the atmospheric pressure. The valve includes a base film having an aperture, and a valve film superimposed on one surface of the base film to cover the aperture and to define a channel between the base film and the valve film for allowing the high pressure gases given off by the commodity to escape to the exterior through the vent hole and the aperture. The channel has opposed open peripheral edges.

The present invention provides a method for sealing the gas release valve of the above-defined construction and arrangement, comprising the steps of inserting a nozzle into the channel through the aperture in the base film, and introducing a fluid sealant through the nozzle to a position intermediate one peripheral edge of the channel and the circumference of the aperture, thereby filling the channel with the fluid sealant.

According to the sealing method of the invention, the discharge end of the nozzle is inserted into the channel through the aperture in the base film and the sealant is admitted into the channel intermediate one peripheral edge of the channel and the circumference of the aperture through the nozzle end. The insertion of the nozzle causes the channel to be slightly opened, that is, a small gap to be created between the base film and the valve film. This gap allows the entire amount of sealant admitted to quickly spread over the channel so that the sealant is evenly distributed over the channel, ensuring that the channel is filled with the predetermined amount of sealant.

Since the sealant is admitted into the channel intermediate one peripheral edge of the channel and the circumference of the aperture through, the nozzle, the present method eliminates the problem of the sealant leaking about its periphery and surface and hence, the associated container is stained with the sealant as experienced in applying the sealant to an outer end of the channel as well as the problem of the sealant is left near the aperture penetrating into the container through the vent hole as experienced in applying the sealant to the inner periphery of the aperture. The present method can trimly seal the valve with the sealant, allowing one to handle the valve with ease particularly when the valve is then attached to the packaging container.

The present method only requires the insertion of the nozzle into the channel and introducing the sealant through the nozzle. The method insures a simple sealing operation which may be readily automated. Since the present method avoids sealant deposits about the peripheral edge of the valve, the sealant will never stain the valve itself or the container during valve sealing and attaching operations as The present method also eliminates the problem of sealant spreading to the underside of the valve to affecting bonding of the valve at its underside to the container.

BRIEF DESCRIPTION OF THE DRAWINGS

The above and other objects, features, and advantages of the present invention will be better understood from the following description taken in conjunction with the accompanying drawings, in which.

DESCRIPTION OF THE PREFERRED EMBODIMENT

Figure 1:
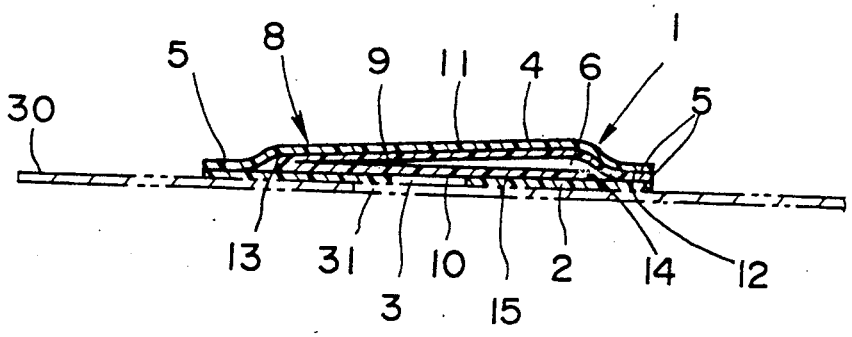
FIGS. 1 and 2 illustrate a gas release valve used in the practice of the present invention, FIG. 1 being a cross-section taken along lines 50—50 in FIG. 2, and FIG. 2 being a partially cut-away plan view, showing a nozzle inserted into the valve channel.
Figure 3:
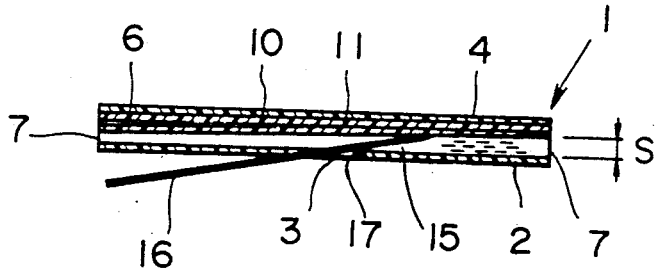
FIG. 3 is a cross-sectional view of the valve taken along lines 60—60 in FIG. 2.
Figure 2:
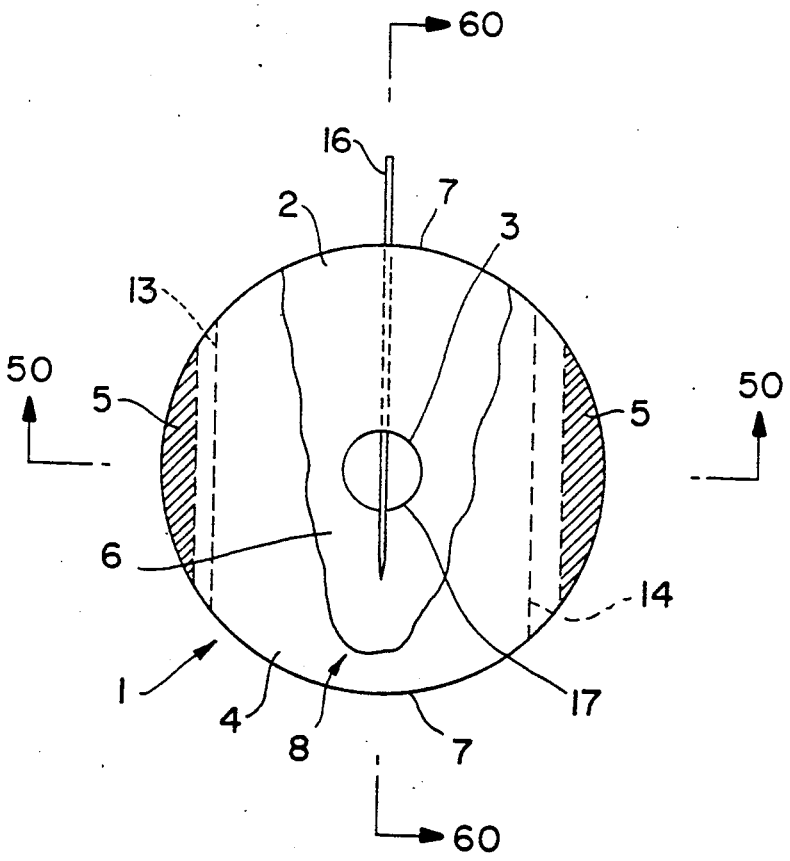

FIGS. 1 to 3 illustrate the gas release valve used in the present sealing method, showing how to practice the present method. The gas release valve generally designated at 1 includes a plastic base film 2 of generally circular shape having an aperture 3 perforated at the center thereof for passage of gases. The valve also includes a plastic cover film 4 in the form of a circular inverted dish having substantially the same outer configuration as the base film 2. The cover film 4 is disposed on one surface of the base film 2 and they are bonded partially along their outer periphery, that is, at crescent portions 5, as by heat bonding. The bonded segments 5 are shaded in the plan view of FIG. 2. The segmental bonds between the films give a valve body 8 of a sleeve structure in which a space 6 is defined in the interior and the remaining peripheral portions 7, 7 are free or open. The space 6 is thus in communication with the ambient air.

The valve 1 further includes a closure member 9 disposed in the space 6 of the valve body 8 for blocking the aperture 3 in the base film 2. The closure member 9 is a piece of plastic film folded approximately along its centerline into upper and lower halves. One half of the plastic film or closure member 9 constitutes a valve film 10 which is directly superimposed on one surface of the base film 2 to cover the aperture 3 therein. The other half constitutes a biasing section 11 which is disposed in the space 6 with its outer surface in contact with the inner surface of the cover film 4. The biasing section 11 of the closure member 9 at its end 12 is sandwiched and secured or bonded between the base and cover films 2 and 4. The fold 13 between the valve film section 10 and the biasing section 11 extends parallel to the side of the lefthand bonded segment 5 in FIG. 2 and a free end 14 of the valve film section 10 extends parallel to the side of the righthand bonded segment 5 in FIG. 2 (both shown in phantom lines). With this arrangement, the biasing section 11 of the closure member 9 urges the valve film 10 in close contact with the upper or inside surface of the base film 2 because of the flexural modulus of plastic film. The base film 2 and the valve film 10 defines therebetween a channel 15 which is the interface between these films in the normal state. Thus the channel 15 is coextensive with the valve film 10 and bounded by diametrically opposed peripheral edge 8 and the fold and free end sides 13 and 14 of the valve film 10.

The valve 1 is later attached to a packaging container 30 such that the aperture 3 is disposed in registry, that is, in fluid communication with a vent 31 in the container 30. Insofar as the gas pressure in the container 30 is approximately equal to the gas pressure in the valve body 8 which is equal to the atmospheric pressure, the lower or outside surface of the valve film 10 is biased in close contact with the upper or inside surface of the base film 2, preventing the gases in the container 30 from entering the inside of the valve body 8 through the vent hole 31 and the aperture 3. If the gas pressure in the container rises a present amount above the gas pressure in the valve body 8, then the increased gas pressure urges upward the valve film 10 against the flexural modulus, separating the valve film 10 from the base film 2 to create a gap therebetween. The gap constitutes a gas flowpath or channel 15 through which the gases escape from the aperture 3 and the vent hole 31 in the container wall 30.

FIGS. 2 and 3 illustrate a nozzle 16 inserted into the gap or channel 15 between the base film 2 and the valve film 10 for explaining how to seal the valve 1 with a fluid sealant such as silicone oil.

More particularly, the injection tip of the nozzle 16 is inserted into the channel 15 through the aperture 3 to a position intermediate one peripheral edge 7 of the channel 15 and the circumference 17 of the aperture 3. Then a fluid sealant (not shown) is introduced into the channel 15 or space 6 through the injection tip of the nozzle 16. Since the sealant is injected at the intermediate position between the channel periphery 7 and the aperture 3 into the channel 15 which is slightly opened by inserting the nozzle 16, the sealant will quickly spread over the channel 15 to form an extensive seal. The channel 15 is evenly filled with the entire amount of sealant injected. It is thus possible to introduce and spread the minimum necessary shot of fluid sealant over the entire extent of the channel 15.

At the end of injection of the sealant, the nozzle 16 is withdrawn from the channel 15. The valve film 10 resumes to the flattened position in close contact with the base film 2, but through a thin layer of sealant this time.

The valve 1 is adhesively bonded to a packaging container 30 such that the aperture 3 is disposed in registry with a vent 31 in the container 30. The present invention eliminates a substantial burden from the attachment operation. The fact that the sealant is introduced to an intermediate of the channel 15 between one peripheral edge 7 of the channel and the circumference 17 of the aperture 3 in the previous sealing operation contributes to some advantages. One advantage is that no extra sealant adheres to the channel peripheral edge 7, preventing the contamination of the container surface which would otherwise occur with the squeeze-out sealant excessively deposited to the valve periphery. Another advantage is that no excess amount of sealant adheres near to the circumference of the aperture 3, preventing the substantial entry of sealant into the container which would otherwise occur after the valve is attached to the container. In this way, the valve can be attached to the packaging container without the risk of internal or external staining. In addition, because the upper and lower surfaces of the valve 1 including the aperture 3 are cleared of the sealant, the valve can be adhesively bonded to the container without any accidental problems from extra sealant deposits. Since the bonding and attachment is interfered by no means, the valve can be firmly affixed to the container. The valve may be adhesively bonded to the container.

The plane configuration of the gas release valve is not limited to the illustrated embodiment of FIGS. 1 to 3.

Figure 4:
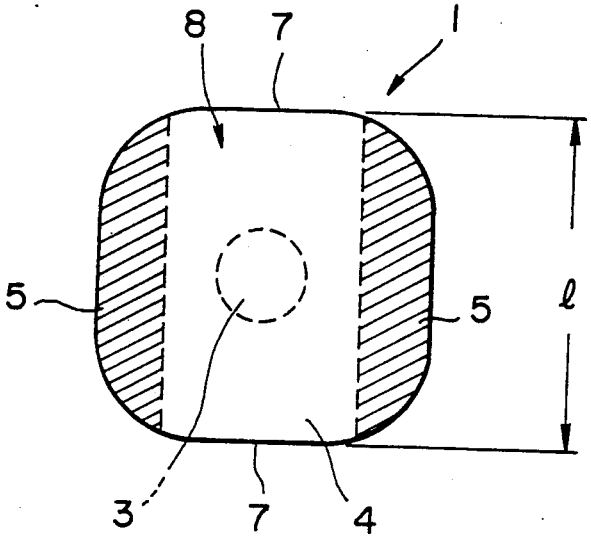
FIG. 4 is a plan view of another gas release valve used in the practice of the present invention.

The valve may have any desired exterior contours including oval, rectangular, square, and other modified shapes, for example, a square shape with its corners rounded as shown in FIG. 4.

The dimensions of the valve may be suitably chosen for a particular utility. For example, the diameter of the circular valve shown in FIG. 2 or the distance l between opposed sides of the modified square valve shown in FIG. 4 may be in the range of from about 15 to about 35 mm, more preferably from about 20 to about 25 mm.

The aperture 3 in the base film 2 may have a diameter of about 4 to about 8 mm.

The thickness of the base film 2 may be selected in a wide range, preferably in the range of from about 100 to about 300 μm, more preferably from about 150 to about 250 μm, most preferably from about 180 to about 220 μm. The cover film 4 and the closure member 9 (or valve film 10) may also have any desired thickness, preferably in the range of from about 20 to about 100 μm, more preferably from about 30 to about 80 μm, most preferably from about 40 to about 60 μm.

The base film 2, cover film 4 and closure member 9 may be formed of any desired materials. For example, the base film 2 is formed of a vinyl chloride resin while the cover film 4 and closure member 9 (or valve film 10) is formed of polyesters, typically polyethylene terephthalate, nylon or the like.

The nozzle 16 used in the practice of the invention may have an outer diameter of about 0.5 to 0.8 mm and an inner diameter of about 0.1 to 0.3 mm defining a passageway for fluid sealant. The shot of sealant fluid admitted into the channel may be of the order of 0.001 to 0.01 ml, typically about 0.005 ml.

When the nozzle 16 is inserted into the valve, the channel 15 is opened as shown in FIG. 3, that is, a space is created between the base and valve films 2 and 10 which are otherwise in close contact. A recommended practice is to insert the nozzle obliquely upward such that the valve film 10 is urged and separated from the base film 2 a maximum distance S of about 1.5 to 3 mm.

Figure 5:
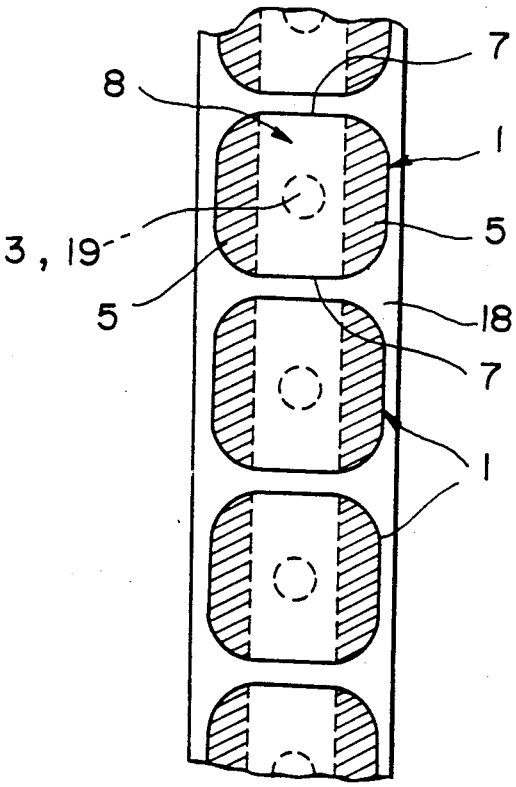
FIG. 5 is a plan view showing a length of tape having a multiplicity of valves attached thereto.
Figure 6:
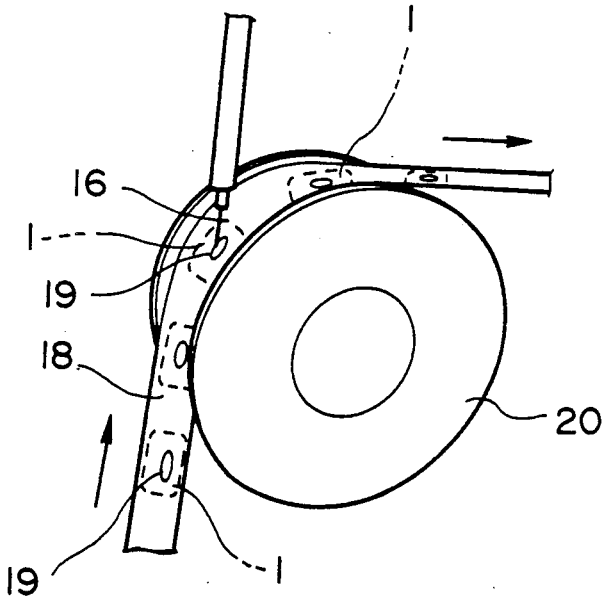
FIG. 6 is a perspective view showing the step of injecting sealant into one of valves on the tape through a nozzle.

It will be understood that a conventional nozzle operating mechanism may be used to automate insertion and withdrawal of the nozzle 16 into and out of the channel 15. Such a preferred practice of the invention is illustrated in FIG. 5 & 6. A continuous length of tape 18 having a release layer of silicone resin applied to the surface is prepared. A multiplicity of valves 1 are adhesively attached to the release layer side of the length of tape at predetermined mutual spacings so that the valves will be individually removed from the tape when needed later. The tape 18 is perforated with a multiplicity of apertures 19 for nozzle insertion at positions corresponding to the apertures 3 of the valves 1 (or base films).

Then the length of tape 18 having a multiplicity of valves 1 attached thereto is extended around a roller 20 of a feed mechanism (not shown) such that the tape may be moved around the roller at predetermined increments from a generally vertical direction to a generally horizontal direction as shown by arrows. A nozzle 16 is disposed above the roller 20 for vertical motion and synchronized with the tape feed mechanism. When the tape 18 is stopped at a predetermined registry position, synchronous actuation causes the nozzle 16 to move downward, enter the channel through the tape aperture 19 and the base film aperture 3 until the nozzle tip reaches a position intermediate one peripheral edge of the channel and the circumference of the aperture 3, and inject a shot of sealant into the channel. The nozzle 16 is then moved upward for withdrawal from the valve. After the nozzle 16 is lifted and withdrawn from the valve, the feed mechanism is actuated again to advance the tape 18 a predetermined distance to position a next valve in registry with the nozzle. Then the above-described operation is repeated. In this preferred embodiment, a multiplicity of valves 1 can be continuously charged with fluid sealant, with benefits of automated, high efficiency sealant injection.

It will be understood that the series of valves having sealant filled therein are then individually stripped from the tape support 18 and attached to packaging containers so as to cover their vents.

Although the nozzle 16 is preferably inserted parallel to the sides of the bonded segments 5 in FIG. 2, the direction of insertion of the nozzle 16 is not particularly limited because the channel is generally symmetric about the aperture. For example, the nozzle may be inserted perpendicular to the illustrated direction in FIG. 2, that is, toward one bonded segment 5 in FIG. 2.

There has been described a gas release valve sealing method by which the gas flowpath or channel is readily and quickly filled with a predetermined shot of fluid sealant to form an extensive uniform seal without causing the sealant to stain the valve itself and the container to which the valve is attached.

Many modifications and changes may be made to the components of the valve used herein as well as the steps of the present invention without departing from the spirit or scope of the invention. It is intended to cover in the appended claims all such modifications as falling within the true spirit and scope of the invention.

I claim:

1. A method for preparing and attaching a gas release valve to a packaging container designed for holding a commodity which generates a small amount of gases over time during shelf storage, the container having a vent hole, the steps comprising:

preparing a gas release valve comprising a base film having an aperture and a valve film superimposed on one surface of the base film covering the aperture and defining therebetween a channel having opposed peripheral edges;

inserting a nozzle into said channel through the aperture so that the nozzle urges the valve film to separate from the base film to create a gap therebetween;

introducing a fluid sealant through the nozzle to the channel at a position intermediate one peripheral edge of the channel and the circumference of the aperture, whereby the gap allows the sealant admitted to spread over the channel so that the sealant is evenly distributed over the sealant, thereby filling the channel with the sealant without depositing the sealant to the periphery of the valve and leaving the sealant in the aperture; and adhesively bonding the base film of the valve having the sealant filled in the channel to the container such that the valve allows the gases given off by the commodity to escape to the exterior through the vent hole and the channel when the gas pressure rises beyond the atmospheric pressure, whereby the valve having no sealant on the outer surfaces thereof is firmly bonded to the container without staining it and no sealant in the aperture of the valve prevents the entry of sealant through the vent hole into the container.

2. A method for preparing and attaching a gas release valve, as recited in claim 1 wherein said introducing step further comprises introducing said nozzle through said aperture at a tangential angle with respect to a plane defined by said base film.

3. A method for preparing and attaching a gas release valve as recited in claim 1, wherein said introducing step further comprises introducing said fluid sealant in amounts between the range of 0.001 to 0.01 ml.

* * * * *